US008009997B2

(12) United States Patent
Ariizumi et al.

(10) Patent No.: US 8,009,997 B2
(45) Date of Patent: Aug. 30, 2011

(54) TONER REPLENISHMENT DETERMINATION DEVICE OF AN IMAGE FORMING APPARATUS

(75) Inventors: Osamu Ariizumi, Kanagawa (JP); Kazumi Kobayashi, Tokyo (JP); Shinji Kobayashi, Kanagawa (JP); Fukutoshi Uchida, Kanagawa (JP); Takashi Enami, Kanagawa (JP); Ryohta Morimoto, Kanagawa (JP); Shin Hasegawa, Kanagawa (JP); Shinji Kato, Kanagawa (JP); Hitoshi Ishibashi, Kanagawa (JP); Kohta Fujimori, Kanagawa (JP); Nobutaka Takeuchi, Kanagawa (JP); Kayoko Tanaka, Tokyo (JP); Yushi Hirayama, Kanagawa (JP); Naoto Watanabe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 848 days.

(21) Appl. No.: 11/556,328

(22) Filed: Nov. 3, 2006

(65) Prior Publication Data

US 2007/0110455 A1 May 17, 2007

(30) Foreign Application Priority Data

Nov. 11, 2005 (JP) ..... 2005-327556
Jun. 22, 2006 (JP) ..... 2006-172950

(51) Int. Cl.
*G03G 15/08* (2006.01)

(52) U.S. Cl. ..... 399/27; 399/58

(58) Field of Classification Search ..... 399/27, 399/58, 258
See application file for complete search history.

(56) References Cited

U.S. PATENT DOCUMENTS

| | | | | |
|---|---|---|---|---|
| 4,880,719 | A * | 11/1989 | Murofushi et al. | |
| 5,349,377 | A * | 9/1994 | Gilliland et al. | |
| 5,387,965 | A | 2/1995 | Hasegawa et al. | |
| 6,404,997 | B1 * | 6/2002 | Grace | 399/27 |
| 6,594,453 | B2 | 7/2003 | Kato | |
| 2004/0028437 | A1 * | 2/2004 | Yoshizuka | |
| 2008/0124107 | A1 | 5/2008 | Takeuchi et al. | |
| 2008/0273885 | A1 | 11/2008 | Koizumi et al. | |

FOREIGN PATENT DOCUMENTS

| | | |
|---|---|---|
| JP | 2003-316144 | 11/2003 |
| JP | 2005-77622 | 3/2005 |

* cited by examiner

*Primary Examiner* — David M Gray
*Assistant Examiner* — Laura K Roth
(74) *Attorney, Agent, or Firm* — Oblon, Spivak, McClelland, Maier & Neustadt, L.L.P.

(57) ABSTRACT

An image forming apparatus, which comprises a toner density detection device for detecting the density of a toner inside a developing device, acquires the number of pixels from inputted image information, calculates the toner replenishment amount from the toner density detection value and the information on the pixels, and thereby performs replenishment control so that excessive replenishment or insufficient replenishment of the toner is not caused. The upper limit value of the amount of toner to be replenished at once to the developing device is changed in accordance with the amount of information on an input image such as the image area, pixels of the input image.

7 Claims, 10 Drawing Sheets

FIG. 2A

LIST OF IMAGE OUTPUT DATA ITEMS FOR CONFIRMING THE EFFECTS

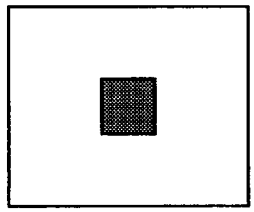

5%

IMAGE-AREA RATIO

FIG. 2B

LIST OF IMAGE OUTPUT DATA ITEMS FOR CONFIRMING THE EFFECTS

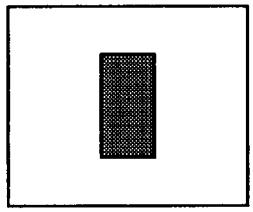

10%

IMAGE-AREA RATIO

FIG. 2C

LIST OF IMAGE OUTPUT DATA ITEMS FOR CONFIRMING THE EFFECTS

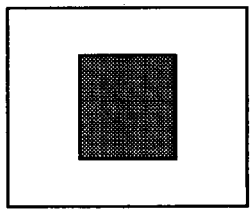

20%

IMAGE-AREA RATIO

FIG. 2D

LIST OF IMAGE OUTPUT DATA ITEMS FOR CONFIRMING THE EFFECTS

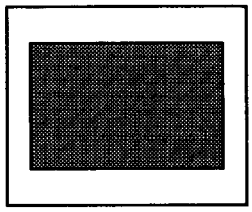

50%

IMAGE-AREA RATIO

FIG. 2E

LIST OF IMAGE OUTPUT DATA ITEMS FOR CONFIRMING THE EFFECTS

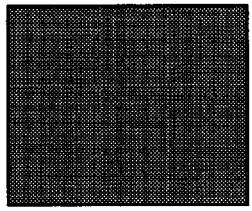

100%

IMAGE-AREA RATIO

FIG. 3

| | IMAGE-AREA RATIO | 5% | | | 10% | | | 20% | | |
|---|---|---|---|---|---|---|---|---|---|---|
| IMAGE DENSITY (ID) | NO LIMIT | 1.70 | 1.40 | 1.65 | 1.60 | 1.52 | 1.41 | 1.70 | 1.34 | 1.82 |
| | FIXED LIMIT | 1.62 | 1.65 | 1.71 | 1.55 | 1.32 | 1.44 | 1.55 | 1.36 | 1.28 |
| | LIMIT LINKED TO THE PIXELS | 1.45 | 1.35 | 1.41 | 1.50 | 1.41 | 1.47 | 1.55 | 1.54 | 1.47 |

| | IMAGE-AREA RATIO | 50% | | | 100% | | | MAX | MIN | MAX-MIN |
|---|---|---|---|---|---|---|---|---|---|---|
| IMAGE DENSITY (ID) | NO LIMIT | 1.90 | 1.75 | 1.93 | 2.10 | 2.09 | 1.85 | 2.10 | 1.34 | 0.76 |
| | FIXED LIMIT | 1.60 | 1.58 | 1.64 | 1.65 | 1.75 | 1.54 | 1.75 | 1.28 | 0.47 |
| | LIMIT LINKED TO THE PIXELS | 1.60 | 1.50 | 1.62 | 1.59 | 1.65 | 1.68 | 1.68 | 1.35 | 0.33 |

FIG. 5

| | | 1 | 2 | 3 | 4 | 5 | 6 | 7 |
|---|---|---|---|---|---|---|---|---|
| IMAGE DENSITY (ID) | NO CORRECTION MADE ON SOLID/LINE | 1.65 | 1.45 | 1.35 | 1.41 | 1.47 | 1.41 | 1.47 |
| | CORRECTION MADE ON SOLID/LINE | 1.55 | 1.55 | 1.42 | 1.50 | 1.48 | 1.63 | 1.55 |

| | | 8 | 9 | 10 | MAX | MIN | MAX-MIN |
|---|---|---|---|---|---|---|---|
| IMAGE DENSITY (ID) | NO CORRECTION MADE ON SOLID/LINE | 1.55 | 1.54 | 1.51 | 1.65 | 1.35 | 0.30 |
| | CORRECTION MADE ON SOLID/LINE | 1.54 | 1.45 | 1.62 | 1.63 | 1.42 | 0.21 |

FIG. 7

| | IMAGE-AREA RATIO | 5% | | | 10% | | | 20% | | |
|---|---|---|---|---|---|---|---|---|---|---|
| IMAGE DENSITY (ID) | NO $\alpha 4$ | 1.45 | 1.35 | 1.41 | 1.50 | 1.41 | 1.47 | 1.55 | 1.54 | 1.47 |
| | WITH $\alpha 4$ | 1.44 | 1.51 | 1.48 | 1.48 | 1.47 | 1.50 | 1.49 | 1.52 | 1.50 |

| | IMAGE-AREA RATIO | 50% | | | 100% | | | MAX | MIN | MAX-MIN |
|---|---|---|---|---|---|---|---|---|---|---|
| IMAGE DENSITY (ID) | NO $\alpha 4$ | 1.60 | 1.50 | 1.62 | 1.59 | 1.65 | 1.68 | 1.68 | 1.35 | 0.33 |
| | WITH $\alpha 4$ | 1.58 | 1.46 | 1.54 | 1.58 | 1.58 | 1.55 | 1.58 | 1.44 | 0.14 |

FIG. 9

(COMPARATIVE EXAMPLE)

| IMAGE-AREA RATIO OF OUTPUT IMAGE (%) | AVERAGE VALUE OF IMAGE AREA RATIOS (%) | REPLENISHMENT AMOUNT UPPER LIMIT (%) (※) |
|---|---|---|
| 4 | 4 | 5 |
| 4 | 4 | 5 |
| 4 | 4 | 5 |
| 4 | 4 | 5 |
| 4 | 4 | 5 |
| 4 | 4 | 5 |
| 4 | 4 | 5 |
| 4 | 4 | 5 |
| 4 | 4 | 5 |
| 4 | 4 | 5 |
| 25 | 6 | 7 |
| 25 | 8 | 9 |
| 25 | 9 | 11 |

REDUCTION IN THE IMAGE DENSITY

※ THE UPPER LIMIT VALUE OF THE REPLENISHMENT AMOUNT IS SUPPOSEDLY CALCULATED BASED ON "AVERAGE OF IMAGE-AREA RATIOS ×1.2 TIMES". AT THIS MOMENT, AFTER THE IMAGE-AREA RATIO IS INCREASED, A STATE OF INSUFFICIENT REPLENISHMENT CONTINUES, CAUSING A REDUCTION IN THE IMAGE DENSITY.

TONER REPLENISHMENT DETERMINATION DEVICE OF AN IMAGE FORMING APPARATUS

BACKGROUND OF THE INVENTION

1. Field of the Invention

The present invention relates to an image forming apparatus such as a copying machine, facsimile device, printer, plotter, complex machine and the like.

2. Description of the Related Art

The technologies of image forming apparatuses of recent years have been developing toward high-speed/high-quality image forming apparatuses and remarkably noted because of the high stability of, particularly, the image density. In order to stabilize the image density, it is necessary to perform a suitable control on toner replenishment, and recently a method of performing such control has been a significant issue.

As the means for calculating the replenishment amount by means of the toner replenishment control, there are two methods: a method of calculating, in a pseudo manner, a toner density from mainly a sensor value to replenish a toner (sensor replenishment control); and a method of converting the number of write pixels, image-area ratio, or other write information to the amount of toner consumption, and replenishing the toner by the obtained consumption amount (pixel replenishment control).

The pixel replenishment control is a control method for replenishing the toner by the amount of output pixels (the amount of the consumed toner), and thus has an advantage that the toner replenishment amount can be calculated relatively accurately. However, the amount of toner which is actually used for development is a cause of errors in the ratios of line images/solid images, the ratio of vertical line images, and the ratio of the horizontal line images, and such errors accumulate gradually when printing a plurality of pages, thus it is difficult to constantly control the image density by means of only the replenishment control (pixel ratio control) of the toner proportional to the image-area ratio.

On the other hand, as the sensor replenishment control, there is known a replenishment control method which uses a density sensor utilizing the changes in the permeability of a developer inside a developer container, the changes being caused by the toner density. However, as described in a number of conventional technologies, this control method has changing factors such as reduction of sensor outputs caused by air stirring of the developer or increase of sensor outputs which is caused because the apparatus was left untouched for a long period of time. Therefore, in the case in which such an error is considerably big in the density variation, if a toner is replenished directly without carrying out a correction such as upper limit processing or the like, density variation occurs.

Therefore, as the toner replenishment control method, it is general to use a control method in which the pixel replenishment control and the sensor replenishment control are combined.

However, even in this simultaneous control of both pixel replenishment control and sensor replenishment control, the replenishment amount may fluctuate. For example, when outputting an image having a high image density (high image-area) or the like, control for replenishing a toner at once acts from the both pixel replenishment control and sensor replenishment control. At this moment, the replenishment amount may become excess, causing a drawback such as toner scattering or the like.

For example, in an image forming apparatus of a type in which a digital latent image is formed by using a laser scanner, LED array or the like, toner consumption amount per page can be estimated relatively accurately from a cumulative total value of the number of printing pixels in an image information signal per page. In the case in which automatic toner replenishment control is performed by a system for determining the tone replenishment amount in response to this estimated consumption amount, when one or more images with a printing ratio of as high as 80% or more are outputted during the automatic toner replenishment control, a toner is supplied at once, and development may be executed without sufficiently charging the toner, causing fogging or toner scattering. In view of such a conventional technology, Japanese Patent Application Laid-Open No. 2003-316144, for example, discloses an example of developer density control for performing a control in which an upper limit value and lower limit value are determined for the replenishment amount of a toner to be supplied at single toner replenishment, and, when a calculated replenishment amount exceeds the upper limit value, the excess amount is carried over to the next toner replenishment amount, while, when the calculated replenishment amount does not reach the lower limit value, the replenishment amount is carried over to the next toner replenishment amount.

In this known control technology, the upper limit of the replenishment amount is determined based on the replenishment amount of a high printing ratio image, thus this technology is effective to cope with problems occurring at the time of replenishment for the high printing ratio image. However, since the upper limit value is determined uniquely (to a fixed value) regardless of the image printing ratio, it can be fully expected that a problem is caused by the excessive replenishment amount at the time of replenishment for a low printing ratio image. When considering that the amount of toner to be replenished (=consumption amount in printing) is proportional to an image-area ratio, the above fact is based on the idea that the upper limit value for the replenishment amount, which is set in view of the above-described causes of error, fluctuation, and fluctuation of actual replenishment amount, should also be made proportional to the image-area ratio to a certain extent.

On the other hand, regarding the toner replenishment control, Japanese Patent Application Laid-Open No. 2005-77622 discloses a technology in which, in the case where a toner replenishment amount, which is acquired based on the amount of toner consumed in formation of a toner image, exceeds a predefined replenishment lower limit value, and where this controlled amount of toner exceeds a replenishment upper limit value which is an upper limit value of the amount of toner replenished at single replenishment operation, a toner in the amount of the replenishment upper limit value is replenished, and in the case where the toner replenishment amount, which is acquired based on the amount of toner consumed in formation of a toner image, exceeds the predefined replenishment lower limit value, and where this toner replenishment amount is below the replenishment upper limit value, this toner replenishment amount is replenished. This patent application discloses that the toner replenishment upper limit value is appropriately set in response to the amount of change in an average toner density which is acquired based on image data.

In addition, in the pixel replenishment control, in an output image the number of pixels in a line image is same as the number of pixels in a solid image. However, since the consumption amount of toner is different in both line and solid images, if the number of line images is high, the toner consumption amount is large in the line images than in the solid image. The reason is because the adhesion amount of the toner becomes higher in the line image than in the solid part because of the edge effect of a latent image.

Furthermore, in recent image forming apparatuses, the diameter of particles in a developer has been gradually reduced in order to obtain high-quality images. Particularly in two-component development, reduction of the diameter of particles in a carrier worsens the liquidity of the developer. For this reason, even when a toner for replenishment is added, it is not easily mixed with the carrier, and when a bit more toner is replenished, a toner which is not mixed with the carrier is generated, thus there is a high possibility that toner scattering is caused and the image quality is deteriorated. Specifically, more appropriate replenishment control needs to be performed for reduction of the diameter of particles in the developer.

SUMMARY OF THE INVENTION

An object of the present invention is to provide an image forming apparatus capable of performing replenishment control so that the amount of toner to be replenishment does not become excess or insufficient.

In an aspect of the present invention, an image forming apparatus forms an electrostatic latent image on an image supporting body and develops the electrostatic latent image by means of a two-component developer supplied from a developing device. An upper limit value of the amount of toner to be replenished to the developing device is calculated based on the number of write pixels.

In another aspect of the present invention, an image forming apparatus forms an electrostatic latent image on an image supporting body and develops the electrostatic latent image by means of a two-component developer supplied from a developing device. An upper limit value of the amount of toner to be replenished to the developing device is calculated based on the ratio between the number of write pixels and the number of pixels in a line image (line drawing) which constitutes a proportion of the number of write pixels.

In another aspect of the present invention, an image forming apparatus forms an electrostatic latent image on an image supporting body and develops the electrostatic latent image by means of a two-component developer supplied from a developing device. The amount of toner to be replenished to the developing device is calculated based on the ratio between the number of write pixels and the number of pixels in a line image (line drawing) which constitutes a proportion of the number of write pixels.

BRIEF DESCRIPTION OF THE DRAWINGS

The above and other objects, features and advantages of the present invention will become more apparent from the following detailed description taken with the accompanying drawings in which:

FIGS. 2A through 2E are figures each showing an image-area ratio of an output image;

FIG. 3 shows tables for comparing image densities obtained when forming an image under different conditions;

FIG. 5 shows tables for comparing image densities obtained when forming an image under different conditions;

FIG. 7 shows tables for comparing image densities obtained when forming an image under different conditions;

FIG. 9 is a figure for explaining a comparative example illustrating conditions for causing a reduction in the image density.

DESCRIPTION OF THE PREFERRED EMBODIMENTS

The present invention is described with reference to the drawings.

Figure 1:
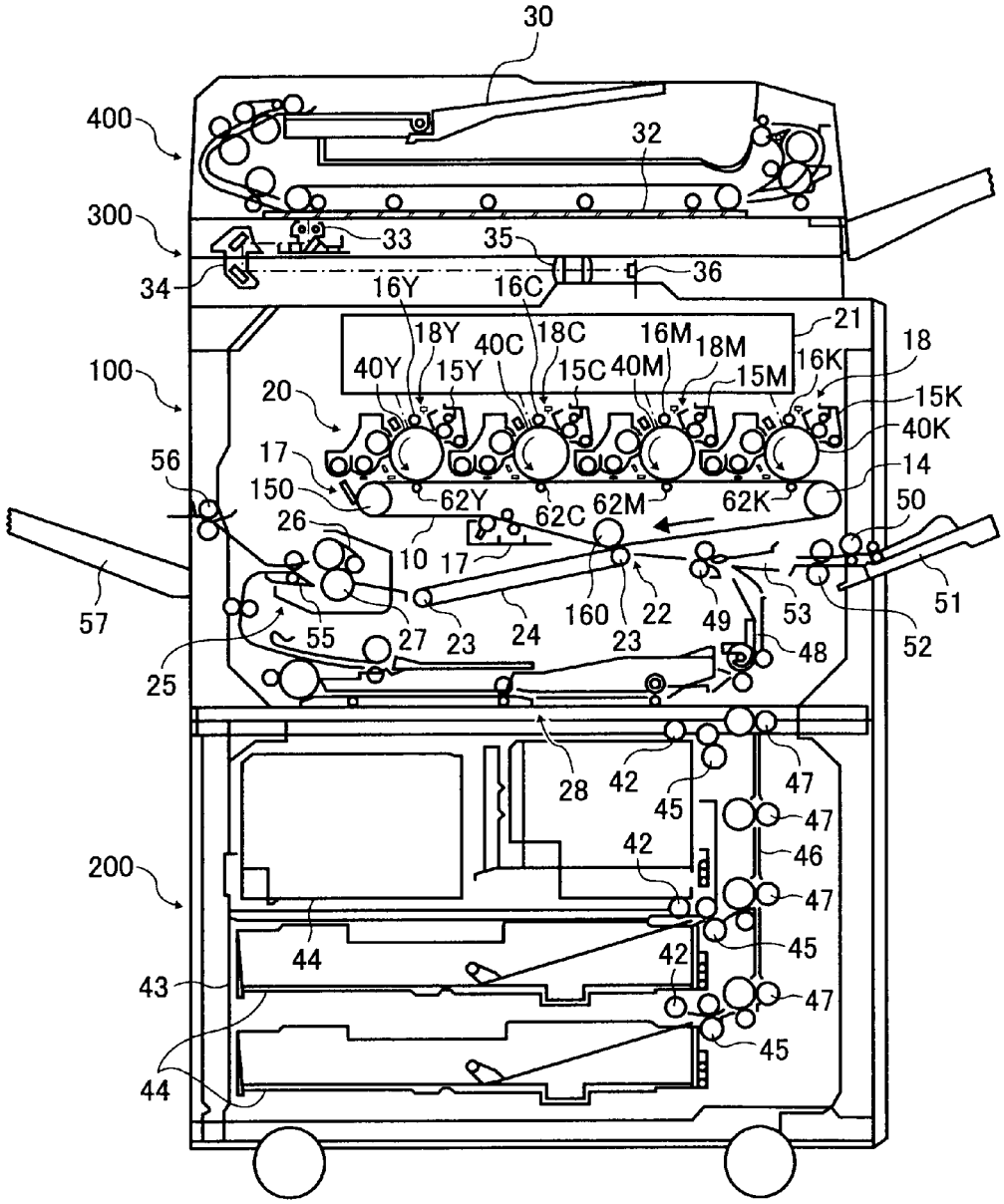
FIG. 1 is a cross-sectional view showing a schematic configuration of an image forming apparatus according to the present invention.

FIG. 1 shows an entire configuration of a full-color copying machine of a tandem intermediate transfer type to which the present invention is applied.

This full-color copying machine comprises an apparatus main body 100, a feed table 200 for mounting the apparatus main body 100 thereon, a scanner 300 attached onto the copying apparatus main body 100, a script automatic conveying device (ADF) 400 attached onto the scanner 300, and the like.

In the center of the apparatus main body 100, image forming units 18Y, 18C, 18M and 18K for four colors, yellow (Y), cyan (C), magenta (M) and black (K) respectively, are arranged in a horizontal direction, whereby a tandem image forming apparatus 20 is configured. The image forming units of the tandem image forming apparatus 20 have, respectively, photoconductors 40Y, 40C, 40M and 40K for forming toner images of the colors Y, C, M and K respectively.

An exposure device 21 is provided in an upper section of the tandem image forming apparatus 20. The exposure device 21 comprises four light sources of laser diode (LD) type which are prepared for each color, a pair of polygon scanners constituted by a six-surface polygon mirror and a polygon motor, fθ lens disposed on an optical path of each light source, a long WTL lens, a mirror, and the like. Laser light emitted from the laser diode in response to the image information on each color is subjected to deflection scanning by the polygon scanner, and is then radiated onto the photoconductor of each color.

An intermediate transfer belt 10 in the form of an endless belt is disposed in a lower section of the tandem image forming apparatus 20. The intermediate transfer belt 10 is wrapped around three supporting rollers 14, 150, 160 in the figure so as to be able to rotate/convey clockwise in the figure, and the supporting roller 14 is a driving roller for rotary driving the intermediate transfer belt. Moreover, between the first supporting roller 14 and the second supporting roller 150, there are provided primary transfer rollers 62Y, C, M, Bk so as to face the photoconductors respectively with the intermediate transfer belt therebetween, the primary transfer rollers functioning as primary transfer means for transferring a toner image from the photoconductors of the respective colors to the intermediate transfer belt.

At a downstream of the third supporting roller 160, which is the direction of rotation shown by an arrow, there is provided an intermediate transfer belt cleaning device 17 for removing residual toner remaining on the intermediate transfer belt 10 after image transfer. As the material of the intermediate transfer belt 10, polyvinylidene fluoride, polyimide, polycarbonate, polyethylene terephthalate, or the like is used, and such material can be molded into a seamless belt. Such material can be used as is or can be subjected to resistance regulation by a conductive material such as carbon black. Moreover, such resin may be formed as a base layer, and, by using a spray or dipping method, a surface layer may be formed to configure a laminated structure.

A secondary transfer device 22 is disposed in a lower section of the intermediate transfer belt 10. In the example shown in the figure, the secondary transfer device 22 is configured such that a secondary transfer belt 24, which is an endless belt, is wrapped around two rollers 23, and is pressed against the third supporting roller 160 via the intermediate transfer roller 10 so that an image on the intermediate transfer belt 10 is transferred to a transfer material. As the material of the secondary transfer belt 24, the same material as the transfer intermediate transfer belt 10 can be used.

A fixing device 25 for fixing an image formed on the transfer material is provided on a side of the secondary transfer device 22. The fixing device 25 is configured such that a pressing roller 27 is pressed against a fixing belt 26 which is an endless belt. The secondary transfer device 22 also has a sheet conveying function for conveying the transfer material obtained after image transfer to the fixing device 25. Of course, as the secondary transfer device 22, a transfer roller or a transfer charger may be disposed, and in this case it is necessary to provide the transfer material conveying function separately.

It should be noted that a reversing device 28 for reversing and delivering the transfer material or reversing and supplying the transfer material again in order to form an image on both sides of the transfer paper is provided in parallel with the tandem image forming apparatus in a lower section of the secondary transfer device 22 and fixing device 25 as shown in the figure. When performing copying using this full-color copying machine, an original copy is set on a script board 30 of the ADF. Alternatively, the ADF 400 is opened, an original copy is set on a contact glass 32 of the scanner, and then the ADF 400 is closed to press the original copy.

By pressing a start switch of an operation section which is not shown, the original copy which is set on the ADF 400 is conveyed and moved onto the contact glass 32. When, on the other hand, the original copy is set on the contact glass 32 the scanner 300 is driven immediately. Accordingly, a first moving body 33 and second moving body 34 are moved. Light from the light source is reflected at the first moving body 33, at the same time the reflected light from the surface of the original copy is further reflected and directed toward the second moving body 34, and the reflected light is reflected using a mirror of the second moving body 34 and caused to enter a reading sensor 36 through an image forming lens 35, whereby the contents of the original copy is read.

Thereafter, in the case in which the mode setting or automatic mode selection is established in the operation section, an image forming operation is started at a full-color mode or monochrome mode in accordance with a result of reading the original copy.

In the case in which the full-color mode is selected, each of the photoconductors 40Y, 40C, 40M and 40K rotates in a counterclockwise direction in FIG. 1. Then, the surface of each photoconductor is charged uniformly by each of the charging rollers 16Y, 16C, 16M and 16K which are the charging devices. Laser light corresponding to an image of each color is emitted from the exposure device 21 onto each photoconductor 40Y, 40C, 40M and 40K of each color, and a latent image corresponding to image data of each color is formed.

By rotating the photoconductors 40Y, 40C, 40M and 40K, the latent image is developed using the toner of each color by a developing device 15Y, 15C, 15M, 15K. Here, the toners are replenished into the developing devices respectively from a toner storage section such as a toner tank or toner bottle (not shown) via toner replenishing devices (not shown). Toner images of the respective colors are sequentially transferred onto the intermediate transfer belt 10 as the intermediate transfer belt 10 is conveyed, whereby a full-color image is formed on the intermediate transfer belt 10.

On the other hand, either a feed table 43 or a feed roller 42 is selected and rotated, and the transfer material is sent out from one of paper cassettes 44 provided in multiple stages in the feed table 43. The transfer material is divided into pieces by a dividing roller 45, fed to a feed path 46, conveyed by a conveying roller 47, guided to a feed path 48 inside the main body, caused to abut against a resist roller 49, and then stopped. Alternatively, a feed roller 50 is rotated to send out the transfer material positioned on a paper feed tray 51. The transfer paper is then divided into pieces by a dividing roller 52, fed to a paper feed path 53, caused to abut against the resist roller 49, and then stopped. The resist roller 49 is rotated so as to be timed with the full-color image formed on the intermediate transfer belt 10. The transfer material is sent to a space between the intermediate transfer belt 10 and the secondary transfer device 22. The secondary transfer device 22 transfers the transfer material to transfer a toner image onto the transfer material.

The transfer material, which has the toner image transferred thereon, is conveyed by the secondary transfer device 22, sent to the fixing device 25, and added with heat and pressure by the fixing device 25, whereby the toner image is fixed onto the transfer material. Thereafter, switching is performed by a switching nib 55 so that the transfer material is ejected by an ejecting roller 56 and then stacked on a catch tray 57. Alternatively, switching is performed by the switching nib 55 so that the transfer material is inserted into the sheet reversing device 28. The transfer material is then reversed at the sheet reversing device 28 and fed to the secondary transfer device 22 again so that the image is recorded on the back side as well. Thereafter, the transfer material is ejected onto the catch tray 57 by the ejecting roller 56. From then on, when an instruction for forming at least two images is provided, the above-described image formation processing is repeated.

In the case in which the monochrome mode is selected, the supporting roller 150 moves downward to separate the intermediate transfer belt 10 from the photoconductors 40Y, 40C, 40M and 40K. Only the black photoconductor 40K is rotated in the counterclockwise direction in FIG. 1, the surface of the photoconductor 40K is charged by the charging roller 16K, laser light corresponding to a black image is emitted, and then a latent image is formed. The latent image is developed by a black toner to become a toner image. This toner image is transferred onto the intermediate transfer belt 10. At this moment, the photoconductors of three colors other than K and the developing device are stopped so that wear and tear on the photoconductors and developing device are prevented.

On the other hand, the transfer material is sent out from the paper cassette 44, the transmission of the transfer paper is suspended at the resist roller 49, and then the transfer material is sent so as to be timed with the toner image formed on the intermediate transfer belt 10. The transfer material, which has the toner image transferred thereon by the secondary transfer device 22, is fixed by the fixing device 25 as with the case of the full-color image, and processed through an ejection system corresponding to the specified mode. From then on, when an instruction for forming at least two images is provided, the above-described image formation processing is repeated.

The image formation conditions of the image forming apparatus are described hereinafter.

Diameter of photoconductor: 60 mm

Rotational speed of photoconductor: 282 mm/sec

Distance between photoconductor and developing roller: 0.3 mm

Volume of developer: 380 g

Diameter of toner particle: 7 μm

Diameter of carrier particle: 35 μm

In the present image forming apparatus, each of the developing devices 15Y, 15C, 15M and 15K has a toner density detection device for detecting a toner density. A control device 500 inputs image information which is read by external equipment or a reading sensor 36 connected to the present image formation device, acquires the number of pixels from the inputted image information, and, from the toner density detection value and the acquired information on the pixels, calculates the amount of toner to be replenished from a toner tank or bottle of each color to the developing device 15Y, 15C, 15M or 15K.

In the present invention, in order to stabilize the image density, the following control technology is applied to the control device 500. In the present image forming apparatus, as a replenishment control system, there is introduced a control system in which two control methods are combined: pixel replenishment control 501 for calculating the replenishment amount from the amount of image information related to an input image, e.g. the number of pixels; and sensor replenishment control 503 for detecting the toner density by means of a sensor and to calculate the replenishment amount from fluctuations of the toner density.

To express such a control system, the total replenishment amount H [mg] is calculated as a sum of the replenishment amount in pixel replenishment control, P_P×1 [mg], and the replenishment amount in sensor replenishment control, P_Vt [mg], as shown in an equation (1).

$$H = P_P\times 1 + P_Vt \qquad \text{Eq. (1)}$$

Here, the details of P_P×1 and P_Vt are expressed as follows:

$$P_P\times 1 = (M/A)\times P\times 1\times \alpha 1 \qquad \text{Eq. (2)}$$

M/A: target value of toner adhesion amount per unit area [mg/cm$^2$]

P×1: image area of the input image [cm$^2$]

α1: coefficient of replenishment 1

$$P_Vt = (\text{sensor sensitivity})\times(Vt\text{now} - Vt\text{ref})\times \alpha 2 \qquad \text{Eq. (3)}$$

Vtnow: sensor output value expressing current toner density [V]

Vtref: sensor output value of target toner density [V]

α2: coefficient of replenishment 2

In the Eq. (2), (M/A) is a target value of a toner adhesion amount per unit area on the intermediate transfer belt, P×1 is a value obtained by converting the data of the number of pixels [dot] calculated from the input image data into a unit of [cm$^2$], and α1 is a correction coefficient (fixed value) for correcting the replenishment amount of pixels with respect to the replenishment performance of the machine.

In the Eq. (3), Vtnow is a detection value when the current toner density is detected by the sensor, and Vtref is equivalent to a target toner density. The sensor sensitivity is an output value of the sensor with respect to the toner density, and the unit thereof is [wt %/V]. The coefficient of replenishment α2 is, as with α1, a correction coefficient (fixed value) for correcting the sensor replenishment amount with respect to the replenishment performance of the machine.

A first embodiment of the present invention is described next. This embodiment is characterized in that an upper limit value of the replenishment amount of toner to be replenished to the developing device at once is changed in accordance with the read number of pixels or image-area ratio.

In the present embodiment, an upper limit value of the replenishment amount linked to a toner replenishment amount in pixel replenishment control is set with respect to the replenishment amount expressed by the Eq. (1). The replenishment amount upper limit value here is up to 120% of a pixel replenishment amount expressed by the Eq. (2), and can be expressed by the following equation.

$$H_\text{limit} = 1.2\times P_P\times 1 \qquad \text{Eq. (4)}$$

H_limit: upper limit value of the replenishment amount [mg]

Accordingly, even in the case of a different image area, the image density can be prevented from being changed by an excessive replenishment. In order to confirm the actual effects, experiments were carried out for (case 1) a case in which replenishment control is performed without the upper limit value, (case 2) a case in which the upper limit value is set as a fixed value, and (case 3) a case in which the upper limit value is calculated from a pixel replenishment value, i.e., a case in which the upper limit value is set as the replenishment amount upper limit value linked to a pixel replenishment amount. The image density of an output image was measured.

As a confirming method here, data in which the image-area ratio is changed is outputted as shown in FIGS. 2A through 2E. FIG. 2A schematically shows an image outputting state in which the image-area ratio is 5%, FIG. 2B shows 10% image-area ratio, FIG. 2C shows 20% image-area ratio, FIG. 2D shows 50% image-area ratio, and FIG. 2E shows 100% image-area ratio.

Output image: list of image output data items shown in FIGS. 2A through 2E (image-area ratio: 5%, 10%, 20%, 50%, 100%)

Number of outputted images by means of the output data at each image-area ratio: 3

Moreover, in each replenishment calculation equation, set value α1=1.05, α2=150, and sensor sensitivity=3.0 [wt %/V] are used. However, regarding α1 and α2, different values may be inputted according to the conditions of the machine.

Figure 4:
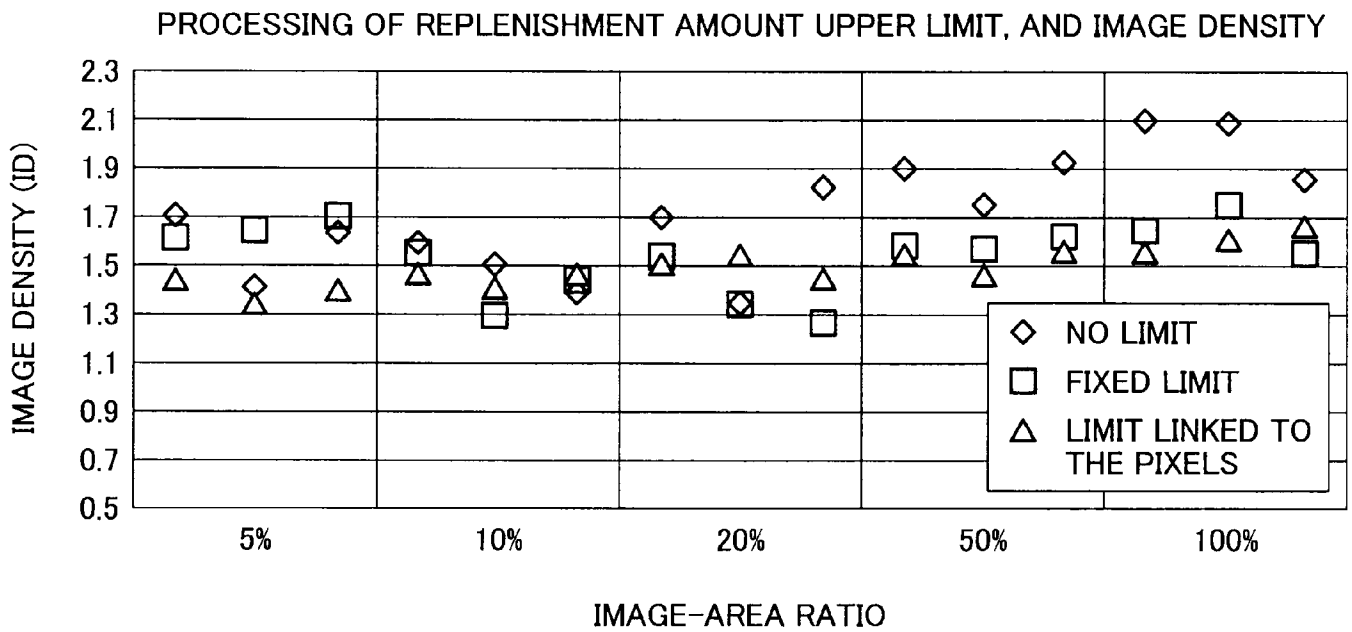
FIG. 4 is a figure showing the tables of FIG. 3 in a form of a graph.

Results of measuring the image density (ID) of an image which is actually outputted using the output data at each image-area ratio are shown in the table of FIG. 3 and in the graph of FIG. 4. In FIG. 3 and FIG. 4, "no limit" corresponds to (case 1) described above, "fixed limit" corresponds to (case 2) described above, and "limit linked to the pixels" corresponds to (case 3) described above.

Ideally, it is desired that the same image density be obtained even when outputting an image at different image-area ratio. In order to observe fluctuations in the image density for each combination of a case and image-area ratio, MAX−MIN (maximum value−minimum value) was calculated to perform the comparison. In the case 3 in which the upper limit value is calculated from a pixel replenishment amount, i.e., in the case in which the upper limit value is set as a replenishment amount upper limit value linked to a pixel replenishment amount, it was confirmed that the image density was stabilized most.

A second embodiment of the present invention is described next. In the present embodiment, the replenishment amount of a toner is changed in accordance with the ratio of a line image (line drawing) in an image to be outputted. The output image is broken into a line section and a solid section to calculate the ratio of a line image, and the toner replenishment amount to the developing device is changed in accordance with the ratio. In this case, the present embodiment is to change, in accordance with image information, the upper limit value of the amount of toner to be replenished at once, and, for example, to slightly increase the replenishment amount at the line section. The present embodiment is described hereinafter.

The image data of the output image can be divided into line section data (edge section/character section) P×1_line and solid section data (pictographic image section) P×1_beta by detecting edges through image processing.

Here, the pixel replenishment control equation of the Eq. (2) described above is changed as follows:

$$P_P\times1=M\times P\times1\times\alpha1\times\alpha3 \quad \text{Eq. (5)}$$

Here, α3 is calculated as the replenishment amount/correction amount based on the solid/line ratio.

$$\alpha3=P\times1_beta/(P\times1_beta+P\times1_line)+Coef_B1\times P\times1_line/(P\times1_beta+P\times1_line) \quad \text{Eq. (6)}$$

Coef_B1: ratio of the adhesion amount in the solid and line sections

As described above, in the present embodiment the upper limit value of the toner replenishment amount to the developing device is calculated based on the ratio between the number of write pixels and the number of pixels in a line image (line drawing) which constitutes a proportion of the abovementioned number of write pixels.

Next, in a third embodiment of the present invention, a replenishment amount upper limit value linked to the toner replenishment amount in pixel replenishment control is set with respect to the replenishment amount expressed by the Eq. (5). The replenishment amount upper limit value here is up to 120% of the pixel replenishment amount obtained using the Eq. (5) and Eq. (6), and can be expressed by the following equation Eq. (4a).

$$H_limit=1.2\times P_P\times1 \quad \text{Eq. (4a)}$$

H_limit: upper limit value of the replenishment amount [mg]

Specifically, the upper limit value of the toner replenishment amount to the developing device is calculated based on the ratio between the number of write pixels and the number of pixels in a line image (line drawing) which constitutes a proportion of the abovementioned number of write pixels.

(Case 4): For the purpose of comparison, an image was outputted by means of replenishment control of the toner on the basis of, not the Eq. (5) and Eq. (6), but the Eq. (2) (toner replenishment control by means of the pixel replenishment control system corresponding to the case 3 above) and the image density of a solid section in this image was measured.

(Case 5): An image was outputted with Coef_B1=1.3 by means of the toner replenishment control (replenishment control of the solid/line ratio) according to the present embodiment based on the Eq. (5) and Eq. (6) above, and the image density of a solid section in which image was measured.

Ten pieces of such image were repeatedly outputted in both cases, and fluctuations of the image densities were compared in repetition of output when the replenishment control of the solid/line ratio was not performed and when the replenishment control of the solid/ratio was performed.

Figure 6:
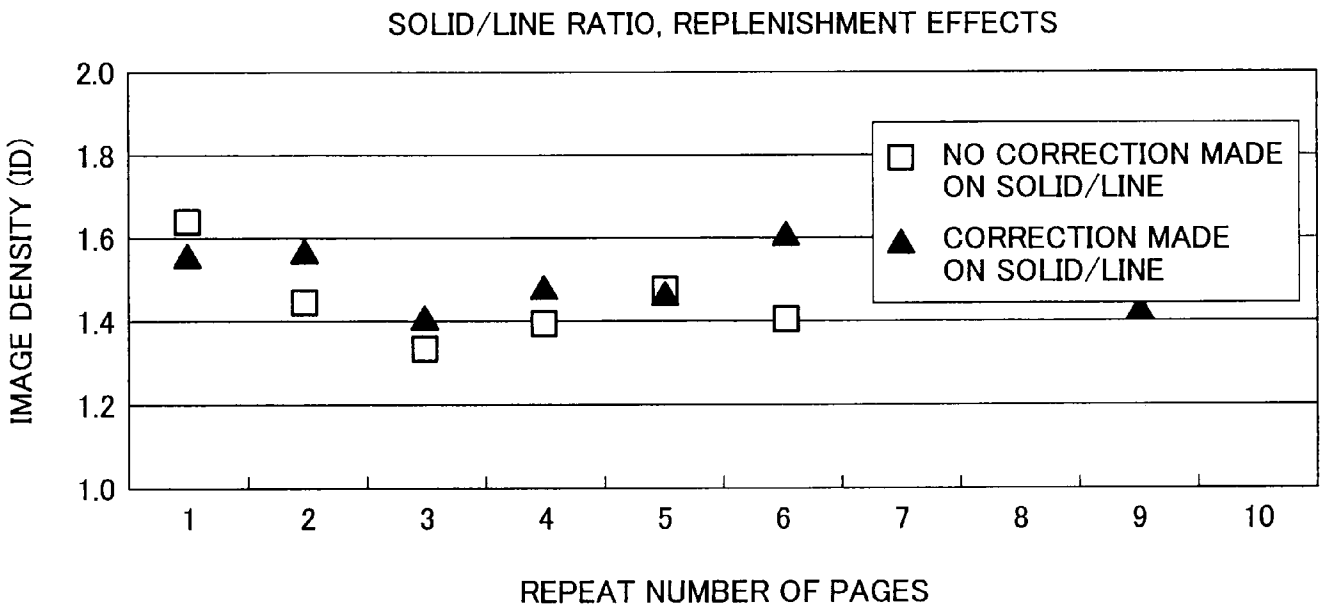
FIG. 6 is a figure showing the tables of FIG. 5 in a form of a graph.

Results of the comparison are shown in FIG. 5 and FIG. 6. In FIG. 5 and FIG. 6, the case 4 is illustrated as "no correction made on solid/line", while the case 5 is illustrated as "correction made on solid/line".

In order to observe fluctuations in the image densities in each case, MAX−MIN (maximum value−minimum value) was calculated to perform the comparison. As a result, it was confirmed that the image density was stabilized most in the case 5 of "correction made on solid/line". As a result, it was confirmed that the replenishment control for preventing the fluctuations from being caused by an image pattern can be realized by correcting the solid/line ratio.

A fourth embodiment of the present invention is described next. In the present embodiment, a toner replenishment amount is calculated from a toner density detection value of the toner inside each of the developing devices 15Y, 15C, 15M and 15K, and the toner replenishment amount calculated from the toner density detection value is linked to the image-area ratio of an input image. Specifically, by linking the coefficient of replenishment α2 to the image-area ratio of the output image in the sensor replenishment control expressed by the Eq. (3), whereby the replenishment amount obtained in the sensor replenishment control is also optimized.

Here, the value of the coefficient of replenishment α2 is made proportional to a value obtained by dividing the output image-area P×1 by a transfer paper size S. The value of P×1/S is equivalent to the image-area ratio of the output image with respect to a transfer material.

In the present embodiment, correction of the replenishment amount, which is suitable for the output image, was realized by multiplying the image-area ratio by the sensor replenishment amount.

$$\alpha2=P\times1/S\times\alpha4 \quad \text{Eq. (7)}$$

S: transfer paper size [$Cm^2$]

α4: coefficient of replenishment 4 (fixed value)

Here, in order to confirm the actual effects, image output evaluation was performed for the image-area ratios of 5%, 10%, 20%, 50%, and 100% according to the example in which the results shown in FIG. 2 through FIG. 4 in the first embodiment were obtained. 150 (coefficient) is used as α4 in the Eq. (7), but this value is changed in accordance with a machine.

Figure 8:
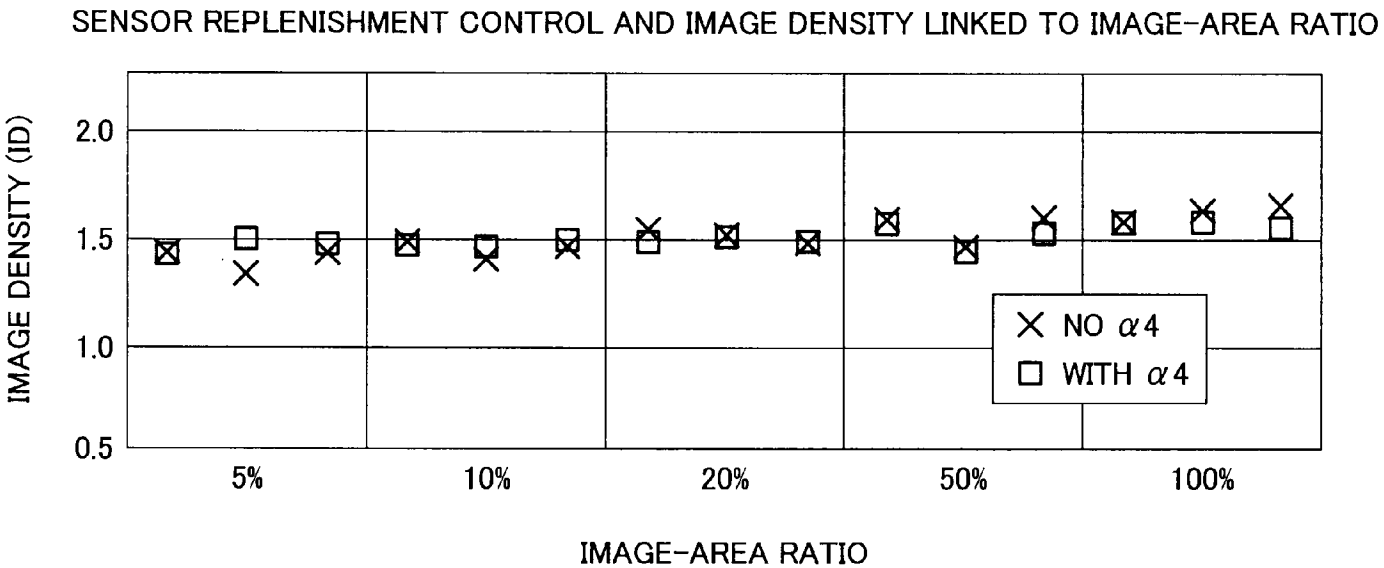
FIG. 8 is a figure showing the tables of FIG. 7 in a form of a graph.
Figure 10:
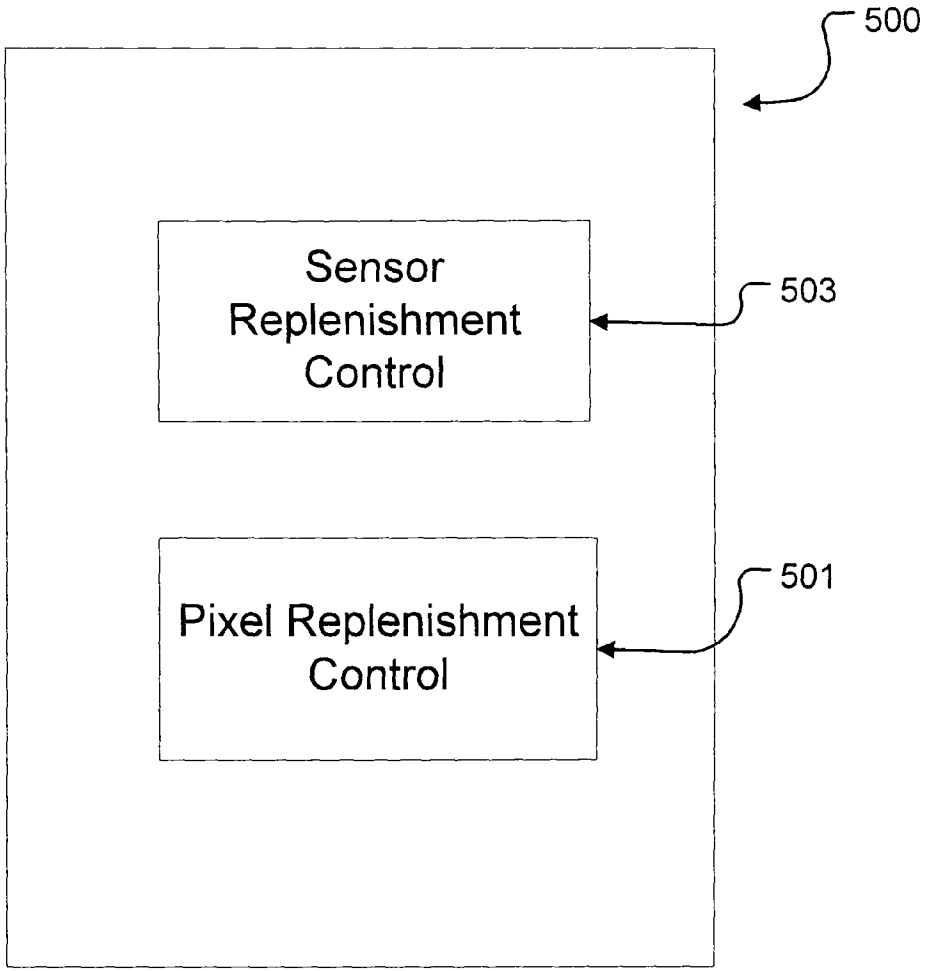
FIG. 10 shows a control device of an image forming apparatus.

(Case 6): The coefficient of replenishment α2 is not linked to the image-area ratio of an output image. Specifically, this case is a case in which the toner replenishment amount calculated from the toner density detection value is not linked to the image-area ratio of an input image, and "no α4" is shown in FIG. 7 and FIG. 8.

(Case 7): The coefficient of replenishment α2 is linked to the image-area ratio of an output image. Specifically, this case is a case in which the toner replenishment amount calculated from the toner density detection value is linked to the image-area ratio of an input image, and "with α4" is shown in FIG. 7 and FIG. 8.

In order to observe fluctuations in the image density for each combination of a case and image-area ratio, MAX−MIN (maximum value−minimum value) was calculated to perform the comparison. The coefficient of replenishment α2 of the case 7 is linked to the image-area ratio of the output image. Specifically, it was confirmed that the image density was stabilized most in the case in which the toner replenishment amount calculated from the toner density detection value was linked to the image-area ratio of the input image.

From this result, it was confirmed that, by applying the control of the present embodiment, the stability of the image density is improved in a region having a particularly low image-area ratio, and that the fluctuations of the image density are further improved.

A fifth embodiment of the present invention is described next. In the present embodiment, a carrier having small particle diameter is used in the developer in order to achieve high-quality images. By reducing the particle diameter of the carrier, the bulk density of the developer increases. The bulk density of the developer is equivalent to the filling ratio of the developer per unit volume. By reducing the particle diameter of the carrier, the excess space can be reduced, whereby the bulk density increases. However, the packing density of the developer increases in accordance therewith, causing a problem that the developer cannot be mixed easily with a replenishment toner. In the replenishment control according to the first through fourth embodiments of the present invention, the stabilized image density can be provided even when using a carrier having a small volume average particle diameter of 40 μm or less, thus the requirement of obtaining high-quality images are satisfied.

In each of the above-described embodiment, even when the image-area ratio or line ratio of the output image is changed, the occurrence of excessive replenishment was prevented, and an image forming apparatus which provides stable image density was realized. Moreover, an image forming apparatus which provides high-quality images and high stability was realized.

Hereinafter, a comparative example with respect to a conventional technology is described with reference to the present invention.

In the conventional technology, the upper limit value of the toner replenishment amount is determined in accordance with the pixels of an output image. The difference between the conventional technology and the present invention is that in the conventional technology the upper limit of the replenishment amount is determined from the average value and cumulative total value of the output pixels, while in the present invention the replenishment amount upper limit is determined from the pixels of an image always when outputting the image or immediately before outputting the image.

An optimal control method for the toner replenishment control is to replenish the toner by the consumed amount. However, it is difficult to actually supply the replenishment amount in accordance with the calculation, thus normally upper limit processing is provided for the replenishment amount in order to avoid excessive replenishment. In the case in which the upper limit value used in this upper limit processing is a fixed value, fluctuations occur in the image density such that insufficient replenishment occurs when the toner consumption is significant, or excessive replenishment occurs when the toner consumption is small.

In the case in which the upper limit processing is performed based on the average value of the output pixels, such processing is preferred when outputting images having the same image-area ratio. However, when the image-area ratios of images to be outputted are changed significantly, insufficient supply or excessive supply is caused as with the case in which the upper limit value is set as a fixed value. Particularly, in a machine which outputs full-color images, fluctuations of the image-area ratios of images to be outputted are significant.

For example, in the case in which a full-color map or the like having high image-area ratio is outputted after outputting color excel data or the like having low image-area ratio, insufficient replenishment occurs because the replenishment amount upper limit value is set with low image-area ratio, causing fluctuations in the image density. An example of such a case is shown in FIG. 9.

Especially in recent years, due to the reduction in size of the unit, the amount of the developer is reduced, thus fluctuations in the image density, toner scattering and the like are easily caused by insufficient replenishment or excessive replenishment. In order to prevent the occurrence of such problems, it is necessary to always calculate the replenishment amount upper limit value in accordance with the image-area ratio of an output image, instead of determining the upper limit value of replenishing time on the basis of the average value or cumulative total value of the image-area ratios, to set the optimum replenishment amount and replenishment amount upper limit value suitable for image output.

A sixth embodiment of the present invention is described next. In the present embodiment, the image-area ratio is large and most toner in a developing unit is used in an image. When fresh toner is replenished from a toner replenishing device, the toner is not charged sufficiently in the developing unit. Under such circumstances, the charged amount of toner decreases, toner adhesion amount on an image increases, and as a result the image-density increase. Because of such phenomenon, when the image area is large, it is necessary to control the toner replenishment amount by reducing the upper limit value of the toner replenishment amount in the relationship between the image area and the toner replenishment amount.

Specifically, the equation of the first embodiment regarding the upper limit value of the toner replenishment amount is to prevent the upper limit value from increasing as the image area of an input image increases.

$$H_\text{limit}=1.2\times P_P\times 1(P_P\times 1<312)$$

$$H_\text{limit}=1.0\times P_P\times 1+62.4(P_P\times 1\geqq 312) \qquad \text{Eq. (4b)}$$

H_limit: upper limit value of the replenishment amount [mg]

As described above, when the image area exceeds a predetermined value, the relationship between the image area and the replenishment amount upper limit value is changed to reduce the replenishment amount upper limit value per image area, whereby the increase of the image density can be prevented.

A seventh embodiment of the present invention is described next. In addition to the sixth embodiment, the present embodiment is to prevent the occurrence of a so-called "toner removal", which is a phenomenon in which, when a large amount of toner is further replenished into the developing unit, the toner inside the developing unit is carried to a developing sleeve without being mixed with the carrier, and thereby is removed in the form of a cluster on an image. Such a phenomenon is addressed by controlling the toner replenishment amount to a predetermined amount.

Specifically, the equation for the replenishment amount upper limit in the sixth embodiment is expressed as follows:

$$H_\text{limit}=1.2\times P_P\times 1(P_P\times 1<312)$$

$$H_\text{limit}=1.0\times P_P\times 1+62.4(P_P\times 1\geqq 312)$$

$$\text{However, when } H_\text{limit}>560,\ \text{H_limit}=1100 \qquad \text{Eq. (4c)}$$

H_limit: upper limit value of the replenishment amount [mg]

By adding the condition described in the Eq. (4c), toner removal can be prevented from occurring. Moreover, when the toner is replenished until the toner removal occurs, the amount of toner increases without allowing the toner to be charged, thus the image density increases. Therefore, by adding the condition described in the Eq. (4c), the toner replenishment amount can be controlled and the charging amount of the replenished toner can be stabilized to a predetermined value or more, and further the image density can be prevented from increasing.

An eighth embodiment of the present invention is described next. In the present embodiment, under a condition in which the image area is small and thus the toner is hardly consumed, if the toner remaining in the developing unit is continuously stirred without being consumed, the charging amount of the toner increases, the toner adhesion amount on the image decreases, and as a result the image density decreases. In the equation shown in the first embodiment regarding the replenishment amount upper limit value, the replenishment amount is controlled to be reduced, thus the image density decreases.

Therefore, under such a condition in which the toner is hardly consumed and the image area is small, it is necessary to set the toner replenishment amount upper limit to be high with respect to the pixels. Moreover, also under a condition in which the toner is not consumed, the developer is continuously stirred, thus it may be preferred that the a constant amount of toner be replenished in order to prevent the charging amount from increasing. Specifically, an equation for the replenishment amount upper limit value in the seventh embodiment is as follows:

$$H_\text{limit}=1.2\times P_P\times 1(P_P\times 1<312)$$

$$H_\text{limit}=1.0\times P_P\times 1+62.4(P_P\times 1\geqq 312)$$

However, when $H_\text{limit}<10$, $H_\text{limit}=10$, and when $H_\text{limit}>560$, $H_\text{limit}=1100$ Eq. (4d)

Therefore, by raising the lower limit of H_limit, even when the toner is not consumed at all or is hardly consumed, a constant amount of toner can be replenished, whereby reduction of the image density can be prevented from occurring.

As described above, the present invention can provide an image forming apparatus which can perform replenishment control so that excess replenishment or insufficient replenishment of the toner does not occur.

Various modifications will become possible for those skilled in the art after receiving the teachings of the present disclosure without departing from the scope thereof.

What is claimed is:

1. An image forming apparatus for forming an electrostatic latent image on an image supporting body, comprising:

a developing device that develops an electrostatic latent image via a two-component developer that includes a toner and a carrier;

a toner density detection device that detects a toner density; and a control device that acquires a number of write pixels from inputted image data and includes a pixel replenishment control and a sensor replenishment control, wherein the sensor replenishment control determines a sensor replenishment amount based on information from the toner density detection device, wherein the pixel replenishment control determines a pixel replenishment amount based on the acquired number of write pixels, wherein the number of write pixels are divided into line section write pixels based on character section data of a line section and solid section write pixels based on pictographic image data of a solid section, wherein the pixel replenishment control determines an upper limit value of an amount of the toner to be replenished to the developing device based on a ratio between the line section write pixels and the number of write pixels, wherein the amount of toner to be replenished is increased with an increase of the ratio between the number of line section write pixels and the number of write pixels, and wherein a total amount of toner to be replenished is the sum of the sensor replenishment amount and the pixel replenishment amount, and the sensor replenishment amount is linked to an image-area ratio of an input image.

2. The image forming apparatus as claimed in claim 1, wherein the carrier has a small volume average particle diameter of 40 μm or less.

3. An image forming apparatus for forming an electrostatic latent image on an image supporting body, comprising:

a developing device that develops an electrostatic latent image via a two-component developer that includes a toner and a carrier;

a toner density detection device that detects a toner density; and a control device that acquires a number of write pixels from inputted image data and includes a pixel replenishment control and a sensor replenishment control, wherein the sensor replenishment control determines a sensor replenishment amount based on information from the toner density detection device, wherein the pixel replenishment control determines a pixel replenishment amount based on the acquired number of write pixels, wherein the number of write pixels are divided into line section write pixels based on character section data and solid section write pixels based on pictographic image data, wherein the pixel replenishment control determines an upper limit value of an amount of the toner to be replenished to the developing device based on a ratio between the line section write pixels and the number of write pixels, and wherein the relationship between the number of write pixels and the upper limit value of the toner replenishment amount is calculated so as to reduce the upper limit value of the toner replenishment amount when the number of write pixels is large.

4. The image forming apparatus as claimed in claim 3, wherein, when the number of write pixels is at least a predetermined value, the upper limit value of the toner replenishment amount is set as a fixed value.

5. An image forming apparatus for forming an electrostatic latent image on an image supporting body, comprising:

a developing device that develops an electrostatic latent image via a two-component developer that includes a toner and a carrier;

a toner density detection device that detects a toner density; and a control device that acquires a number of write pixels from inputted image data and includes a pixel replenishment control and a sensor replenishment control, wherein the sensor replenishment control determines a sensor replenishment amount based on information from the toner density detection device, wherein the pixel replenishment control determines a pixel replenishment amount based on the acquired number of write pixels, wherein the number of write pixels are divided into line section write pixels based on character section data and solid section write pixels based on pictographic image data, wherein the pixel replenishment control determines an upper limit value of an amount of the toner to be replenished to the developing device based on a ratio between the line section write pixels and the number of write pixels, and wherein the relationship between the number of write pixels and the upper limit value of the toner replenishment amount is calculated so as to increase a lower limit value of the toner replenishment amount when the number of write pixels is small.

6. The image forming apparatus as claimed in claim 5, wherein, when the number of write pixels is a predetermined value or less, the upper limit value of the toner replenishment amount is set as a fixed value.

7. An image forming apparatus for forming an electrostatic latent image on an image supporting body, comprising:

a developing device that develops an electrostatic latent image via a two-component developer that includes a toner and a carrier;

a toner density detection device that detects a toner density; and a control device that acquires a number of write pixels from inputted image data and includes a pixel replenishment control and a sensor replenishment control, wherein the sensor replenishment control determines a sensor replenishment amount based on information from the toner density detection device, wherein the pixel replenishment control determines a pixel replenishment amount based on the acquired number of write pixels, wherein the number of write pixels are divided into line section write pixels based on character section data of a line section and solid section write pixels based on pictographic image data of a solid section, wherein the pixel replenishment control determines an upper limit value of an amount of the toner to be replenished to the developing device based on a ratio between the line section write pixels and the number of write pixels, wherein the amount of toner to be replenished is increased with an increase of the ratio between the number of line section write pixels and the number of write pixels, and wherein the ratio between the line section write pixels and the number of write pixels is multiplied by a ratio of a toner adhesion amount of the solid section and a toner adhesion amount of the line section.

* * * * *